US005533429A

United States Patent [19]

Kozak

[11] Patent Number: 5,533,429

[45] Date of Patent: Jul. 9, 1996

[54] FASTENER DRIVING TOOL INSERT

[76] Inventor: Burton Kozak, 1300 N. Lake Shore Dr., #28C, Chicago, Ill. 60610

[21] Appl. No.: 347,508

[22] Filed: Nov. 30, 1994

[51] Int. Cl.[6] ..... B25B 23/00

[52] U.S. Cl. ..... 81/439; 81/438

[58] Field of Search ..... 81/438, 439, 125, 81/177.85

[56] References Cited

U.S. PATENT DOCUMENTS

| | | | |
|---|---|---|---|
| 3,114,401 | 12/1963 | Johnson | 81/438 |
| 4,404,874 | 9/1983 | Lieser | 81/438 |
| 4,926,721 | 5/1990 | Hsiao | 81/439 |
| 5,309,798 | 5/1994 | Markwart et al. | 81/438 |
| 5,335,409 | 8/1994 | Elvebak | 81/438 |
| 5,341,705 | 8/1994 | Lin | 81/438 |

*Primary Examiner*—Bruce M. Kisliuk
*Assistant Examiner*—Joni B. Danganan
*Attorney, Agent, or Firm*—Marshall, O'Toole, Gerstein, Murray & Borun

[57] ABSTRACT

In order to enhance the effectiveness of a tool for driving a fastener in a clockwise and/or counterclockwise direction, the tool includes a fastener engaging portion, a rotational movement imparting portion, and a releasably retaining portion. The fastener engaging portion is adapted to matingly engage a fastener for clockwise and/or counterclockwise driven movement in response to rotational movement of the fastener engaging portion. The rotational movement imparting portion is adapted to impart rotational movement to the fastener engaging portion to thereby impart driven movement of the fastener in the clockwise and/or counterclockwise direction. The releasably retaining portion is adapted to releasably retain the fastener engaging portion in operative relationship with the rotational movement imparting portion. In addition, the releasably retaining portion transmits rotational movement in a direct and positive manner and includes an expandable/contractible spring for releasably gripping the fastener engaging portion.

12 Claims, 2 Drawing Sheets

FASTENER DRIVING TOOL INSERT

FIELD OF THE INVENTION

The present invention is generally directed to tools and components that are useful therein and, more particularly, a tool for driving fasteners in a clockwise and/or counterclockwise direction.

BACKGROUND

Over the years, there have been significant improvements in tool development for a wide variety of purposes. It is generally recognized that, even in the case of hand tools, there have been advancements that have made such tools far more desirable and versatile to the user. By way of example, there are now a number of hand tools which are capable of performing multiple functions.

More specifically, Eazypower Corporation of Chicago, Ill. offers for sale a manual screwdriver that provides the user with a number of different options. This screwdriver has a handle with an insert or bushing in one end which receives a tube that carries a reversible screwdriver tip in each of the opposing ends thereof. With this arrangement, the tube can be inserted into the insert or bushing in a manner permitting the selective utilization of either of the screwdriver tips.

Of course, the reversible screwdriver tips each include a separate tip on each of the opposing ends thereof. Thus, the screwdriver tips are reversible whenever they are projecting from the exposed end of the tube meaning that either of the tips thereon may be used depending upon the needs at any point in time. As a result of this construction, there are four different tips that are readily available to the user who is in possession of this single hand tool.

As suggested, a tool of this type conventionally has an insert or bushing that serves a number of functions. The insert or bushing in one end of the handle of such a tool must be capable of transmitting torque applied to the handle to thereby transmit rotational movement to the screwdriver tip and, in addition, the insert or bushing must retain the tube holding the screwdriver tip within the handle except when necessary to remove it to utilize one of the tips on the other reversible screwdriver tip. To accomplish these objectives, a tube and insert or bushing have typically been formed in a relatively complex manner.

More specifically, the manual screwdriver is usually formed such that the insert or bushing has conventionally included a pair of diametrically opposite slots in the axial opening in the insert or bushing that is adapted to receive the tube. The insert or bushing has also included a pair of diametrically opposite holes that are offset by 90° from the respective slots. With regard to the tube, it has conventionally been provided with a pair of diametrically opposed projections to be received in the slots of the bushing and a spring detent ball to be received in either of the holes in the bushing.

While this arrangement works relatively well, there are several drawbacks that are of particular significance. First, the slots in the bushing and the projections on the tube can be damaged over time due to the frequent removal and reinsertion of the tube to use the various tips on the reversible screwdriver tips. The projections are relatively small, as are the slots, and thus any damage to either the projections or slots can render it impossible to thereafter transmit torque through the handle in which the bushing is located to the tip that is engaged with a fastener. Second, the spring detent ball also is exposed to the possibility of damage due to the frequent removal and reinsertion of the tube in relation to the bushing and the handle. Moreover, the utilization of the tube for a "4-in-1" screwdriver does nothing to satisfy the need for a "2-in-1" screwdriver.

In view of the foregoing, it has remained to provide an entirely satisfactory tool for driving a fastener in a clockwise and/or counterclockwise direction. The principal requirements to be met include being able to directly and positively transmit torque without fail and also to be able to releasably retain a fastener engaging component within a rotational movement imparting component with a mechanism that is protected from exposure and damage while having sufficient freedom of movement to function fully in its intended fashion. Still additionally, the tool should be capable of being manufactured at a relatively low cost with components that are formed in such a manner as to have an extremely long life.

The present invention is directed to overcoming one or more of the foregoing problems and achieving one or more of the resulting objects.

SUMMARY OF THE INVENTION

It is a principle object of the present invention to provide a tool which may advantageously take the form of a hand tool for driving a fastener in a clockwise and/or counterclockwise direction. It is a further object of the present invention to provide such a tool having an insert or bushing for releasably retaining a fastener engaging component in such a way as to impart rotational movement in a direct and positive manner while also releasably gripping the fastener engaging component with a hidden and protected expandable/contractible spring means. It is yet another object of the present invention to provide such an insert or bushing for a hand tool for driving a fastener in a clockwise and/or counterclockwise direction.

Accordingly, the present invention is directed to achieving these objectives by providing a tool for driving a fastener in a clockwise and/or counterclockwise direction. The tool includes means for matingly engaging the fastener for clockwise and/or counterclockwise driven movement in response to rotational movement of the fastener engaging means. The tool also includes means for imparting rotational movement to the fastener engaging means to thereby impart driven movement to the fastener in the clockwise and/or counterclockwise direction. With this arrangement, the tool further includes means for releasably retaining the fastener engaging means in operative relationship with the movement imparting means.

More specifically, the retaining means includes means for transmitting rotational movement from the movement imparting means in a direct and positive manner to the fastener engaging means, and it also includes expandable/contractible spring means for releasably gripping the fastener engaging means.

In the exemplary embodiment, the retaining means comprises an insert or bushing having an outer surface with an external spring expansion chamber for housing and accommodating expansion of the expandable/contractible spring means. The insert or bushing advantageously has an axially extending opening at one end and is closed at the other end to limit the extent of axial insertion of the fastener engaging means. Still additionally, the insert or bushing preferably has an outer surface formed with generally axially extending serrations comprising at least a portion of the movement transmitting means to cooperate by gripping the inner surface of a handle.

In one embodiment, the insert has an axially extending opening at one end of generally hexagonal shape comprising at least a portion of the movement transmitting means. In another embodiment, the insert has an axially extending opening at one end having a generally cylindrically shaped first portion and a generally hexagonally shaped second portion.

In a highly preferred embodiment, the tool is in the form of a hand tool and the rotational movement imparting means is in the form of a handle to be gripped for the purpose of imparting torque therethrough. The handle is thus adapted to manually impart rotational movement through the insert or bushing which advantageously comprises a generally cylindrical handle insert adapted to transmit manually imparted rotational movement of the handle in a direct and positive manner. Still further, the insert preferably has an outer surface with a radial undercut defining the external spring expansion chamber for housing and accommodating expansion of the expandable/contractible spring means therewithin.

With regard to the insert or bushing, it is advantageously dosed at the end opposite the axially extending opening so as to isolate and preclude the fastener engaging means from engagement with the handle. It will also be appreciated that the generally axially extending serrations on the outer surface of the insert are provided to engage the handle as mentioned above and thus comprise a portion of the movement transmitting means. As for the external spring expansion chamber, it is advantageously disposed at a point generally intermediate the ends of the insert or bushing but nearer the one end having the axially extending opening.

Still additionally, the external spring expansion chamber advantageously has a smooth outwardly-facing surface, and the expandable/contractible spring means comprises a detent suitably disposed within the external spring expansion chamber. The detent includes a ball disposed is a hole through the smooth outwardly-facing cylindrical surface and a band disposed about the cylindrical surface to confine the ball in the hole. With the invention being utilized in a hand tool, the detent including the ball and the band are all confined and protected within the handle in a manner where their expansion and contraction are in no way restricted due to the external spring expansion chamber.

In one embodiment, the axially extending opening in the insert at the one end is of generally hexagonal shape to comprise at least a portion of the movement transmitting means. With this arrangement, the fastener engaging means has at least a portion of generally hexagonal shape to be matingly received in the opening of generally hexagonal shape.

Still more particularly, the axially extending opening of the insert or bushing is advantageously of generally hexagonal shape throughout the entire length thereof. The fastener engaging means advantageously comprises a reversible screwdriver tip having first and second tips on opposite ends thereof. With this arrangement, the reversible screwdriver tip also has a shank intermediate the first and second tips comprising the portion of generally hexagonal shape.

In another embodiment, the axially extending opening of the insert or bushing has a generally cylindrical portion and a generally hexagonal portion remote from the one end. The generally hexagonal portion again defines a part of the movement transmitting means. With this arrangement, the fastener engaging means again has a portion of generally hexagonal shape to be matingly received in and engaged with the generally hexagonal portion of the opening.

Still more specifically, the fastener engaging means then includes as a portion thereof a generally cylindrical tube having an axially extending opening of generally hexagonal shape in each of opposing ends thereof. With this arrangement, the fastener engaging means also includes a reversible screwdriver tip in each of the axially extending openings in the tube having first and second tips on opposite ends and an intermediate shank therebetween.

With regard to this embodiment, the shank of each of the reversible screwdriver tips is again of generally hexagonal shape and is formed to be of a length sufficient to project from the tube when fully inserted thereinto. As a result, the tube is adapted to be inserted into the axially extending opening of the insert to mate the projecting portion of the shank of one of the reversible screwdriver tips with the generally hexagonal portion of the opening in the insert.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
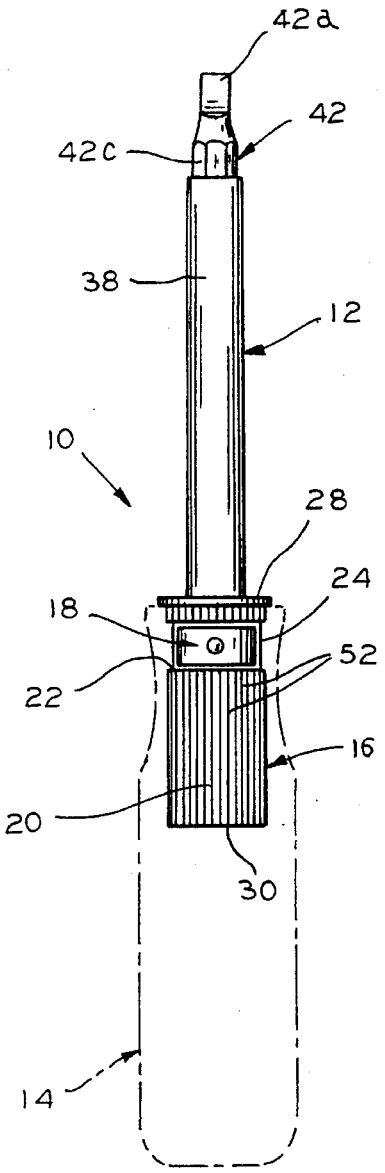
FIG. 1 is an elevational view of a fastener driving tool in accordance with the present invention.

In the illustrations given, and with reference first to FIG. 1, the reference numeral 10 designates generally a tool for driving a fastener in a clockwise and/or counterclockwise direction. The tool 10 will be understood to comprise a hand tool in the illustrated embodiment, and it includes means 12 for matingly engaging a fastener for clockwise and/or counterclockwise driven movement in response to rotational movement, and it also includes means 14 in the form of a handle for manually imparting rotational movement to the fastener engaging means 12 to impart driven movement of the fastener in the clockwise and/or counterclockwise direction. As shown in FIGS. 1–4, tool 10 includes means 16 for releasably retaining the fastener engaging means 12 in operative relationship with the handle 14 in the form of a generally cylindrical handle insert.

Figure 2:
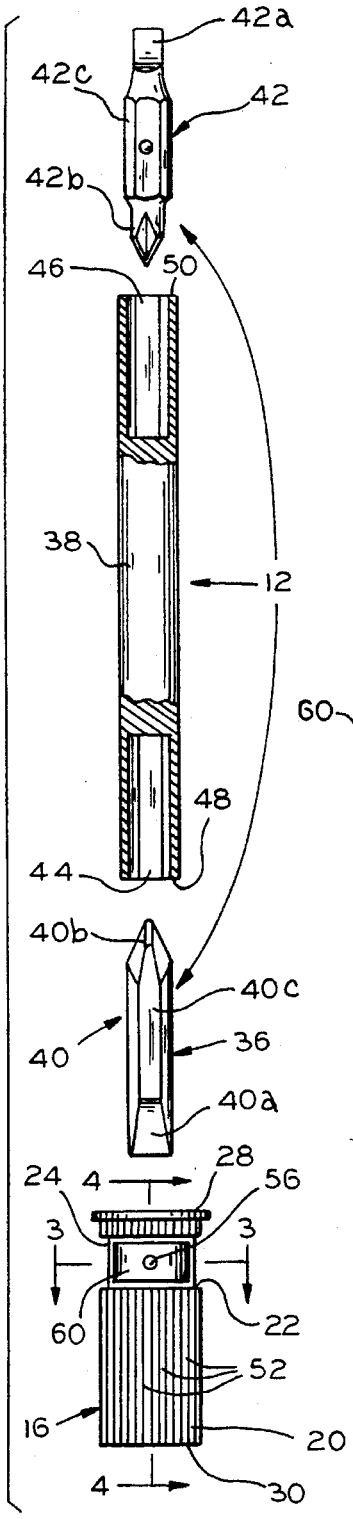
FIG. 2 is an exploded view illustrating the various components of the tool of FIG. 1.
Figure 3:
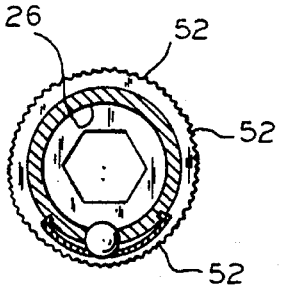
FIG. 3 is a cross sectional view taken generally along the line 3—3 of FIG. 2.
Figure 4:
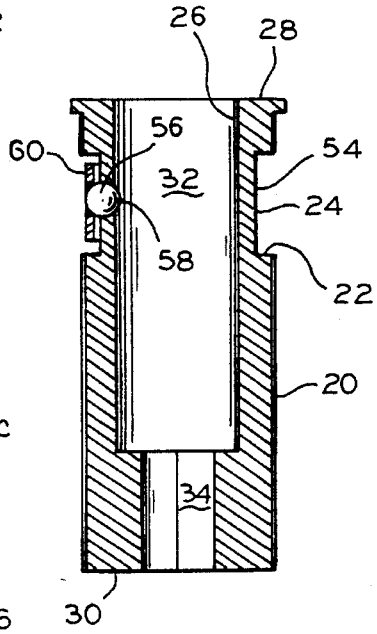
FIG. 4 is a cross sectional view taken generally along the line 4—4 of FIG. 2.
Figure 5:
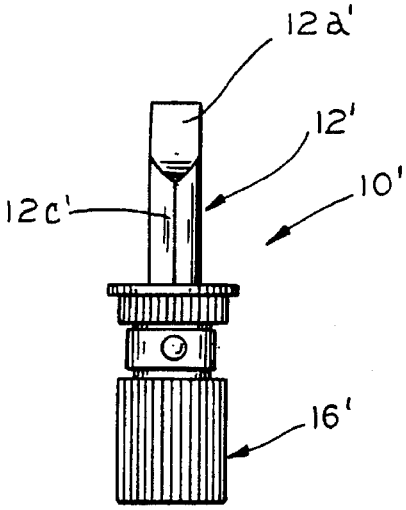
FIG. 5 is an elevational view of the components of an alternative embodiment.
Figure 6:
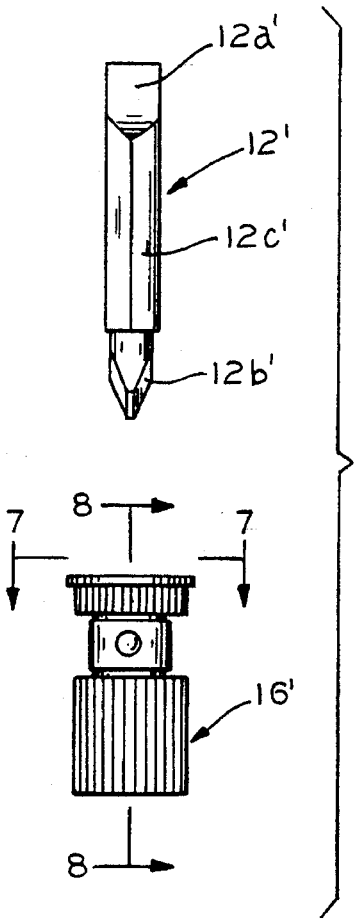
FIG. 6 is an exploded view illustrating the various components of the tool of FIG. 5.
Figure 7:
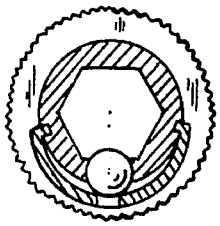
FIG. 7 is a cross sectional view taken generally along the line 7—7 of FIG. 6.
Figure 8:
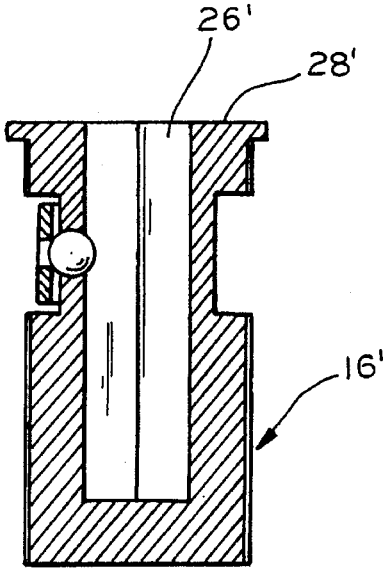
FIG. 8 is a cross sectional view taken generally along the line 8—8 of FIG. 6.

As will be appreciated from FIGS. 2–4, the generally cylindrical handle insert 16 is well suited for transmitting manually imparted rotational movement of the handle 14 in a direct and positive manner to the fastener engaging means 12. It will also be seen that the insert 16 includes expandable/contractible spring means 18 which serves to releasably grip the fastener engaging means 12. More specifically, the insert 16 has an outer surface 20 with a radial undercut 22 defining an external spring expansion chamber 24 for housing and accommodating expansion of the expandable/contractible spring means 18 therewithin.

As best shown in FIG. 4, the insert 16 also has an axially extending opening 26 at one end 28 and is closed at the other end 30 to releasably receive the fastener engaging means 12 in a manner where it is isolated from engagement with the handle 14. The axially extending opening 26 of the insert 16 has a generally cylindrical portion 32 and a generally hexagonal portion 34 remote from the one end 28 to define a part of the movement transmitting means in conjunction with the handle 14, and the fastener engaging means 12 has a portion 36 (see FIG. 2) of generally hexagonal shape to be matingly received in the generally hexagonal portion 34 of the opening 26. In the embodiment illustrated in FIGS. 1 through 4, the fastener engaging means 12 will be understood to comprise a generally cylindrical elongated tube 38 as well as a pair of reversible screwdriver tips generally designated 40 and 42.

Referring specifically to FIG. 2, the generally cylindrical tube 38 has axially extending openings 44 and 46 which are suitably of generally hexagonal shape in each of opposing ends 48 and 50 such that the reversible screwdriver tips 40 and 42 are designed to be disposed therewithin. The reversible screwdriver tips 40 and 42 each have first and second tips 40*a*, 40*b* and 42*a*, 42*b* on their opposite ends and also have respective intermediate shanks 40*c* and 42*c* therebetween. The reversible screwdriver tips 40 and 42 are formed such that the shanks 40*c* and 42*c* are of generally hexagonal shape and of a length to project from-the tube 38 when fully inserted. With these features, the tube 38 is adapted for insertion into the axially extending opening 26 of the insert 16 to place the projecting portion of the shank such as 40*c* and 42*c* of one of the reversible screwdriver tips such as 40 and 42 in the generally hexagonal portion 34 of the opening 26 in the insert 16.

Referring now to FIGS. 2 and 3, the insert 16 has the outer surface 20 formed with a plurality of handle engaging generally axially extending serrations 52 comprising at least another portion of the movement transmitting means in cooperation with the handle 14. The external spring expansion chamber 24 is disposed along the outer surface 20 at a point generally intermediate the ends 28 and 30 of the insert 16 but nearer the one end 28 having the axially extending opening 26, and it is formed to have a smooth outwardly-facing cylindrical surface 54. With this construction, the expandable/contractible spring means 18 comprises a detent including a ball 56 disposed in a hole 58 through the cylindrical surface 54 and a band 60 disposed about the cylindrical surface 54 to confine the ball 56 in the hole 58.

By positioning the expandible/contractible spring means 18 remote from the end 30 where rotational movement is transmitted through the insert or bushing 16 from the handle 14 to the fastener engaging means 12, gripping action of the expandible/contractible spring means 18 takes place at a location relatively isolated from the where the substantial forces are transmitted to the fastener engaging means 12 in use of the tool 10.

Referring now to FIGS. 5–8, the features of an alternative embodiment of hand tool 10' for driving a fastener in a clockwise and/or counterclockwise direction have been fully illustrated. This embodiment is similar in many respects to the hand tool 10 illustrated in FIGS. 1 through 4, but it differs in that the axially extending opening 26' of the insert 16' at the end 28' is of generally hexagonal shape with the generally hexagonal shape of the opening 26' comprising at least a portion of the movement transmitting means in cooperation with the handle. As with the embodiment illustrated in FIGS. 1–4, the fastener engaging means 12' has at least a portion 12*c'* of generally hexagonal shape to be matingly received in the opening 26' of generally hexagonal shape.

In the preferred form of the embodiment shown in FIGS. 5–8, the axially extending opening 26' in the insert 16' is of generally hexagonal shape throughout the length thereof. The fastener engaging means 12' may advantageously comprise a reversible screwdriver tip having first and second tips 12*a'* and 12*b'* on opposite ends thereof. With this arrangement, the reversible screwdriver tip 12' also has a shank 12*c'* intermediate the first and second tips 12*a'* and 12*b'* comprising the aforementioned portion of generally hexagonal shape.

With either embodiment of the present invention, the advantages to be derived are significant in relation to previously known arrangements. The insert, or cylindrical bushing, is unique and may advantageously be utilized with any tool including the specifically illustrated hand tool while enjoying the many significant benefits that are inherent in its design. Of particular significance as an improvement over earlier tools are the unique retention and driving characteristics of the invention.

More specifically, it should now be well appreciated that there are significant benefits resulting from the detent being disposed within the external spring expansion chamber. This portion of the insert, or cylindrical bushing, will typically be confined and protected within an opening in a handle 14 where it is not subjected to torque due to the cooperation of the serrations 52 with the inner surface of the opening in the handle into which the insert, or cylindrical bushing, is press fit and, moreover, no external contact or forces can be applied to the band that would tend to cause it to dislodge from its position surrounding and resiliently gripping the smooth outwardly-facing cylindrical surface 54 where it thereby retains the ball 56 in the hole 58. As will be appreciated, the hole 58 is sized so as to have a smaller diameter than the diameter of the ball 56 to allow it to project only part way through the hole 58 into the axially extending opening 26.

As will also be appreciated, the closed end 30 is important to the functioning of the insert, or cylindrical bushing 16 since it serves to isolate the tip such as 40*a* of the reversible screwdriver tip 40. More specifically, the closed end 30 performs the function of isolating the tip such as 40*a* of the reversible screwdriver tip 40 that is to be inserted into the axially extending opening 26 from engagement with the handle 14, i.e., it prevents the tip such as 40*a* from becoming embedded in the material such as wood or plastic of the handle 14 where it could become incapable of removal. Of course, the same problem could be encountered in connection with the embodiment illustrated in FIGS. 5 and 6 absent an arrangement in which there is a closed end in the insert, or cylindrical bushing.

As a further note, the invention has been illustrated as a screwdriver for driving screws in a clockwise and/or counterclockwise direction. It will be appreciated that this is merely illustrative of one of the many applications that could advantageously utilize the benefits of the invention inasmuch as the invention is well suited for driving any fastener by fashioning the fastener engaging means in the form, e.g., of a nut setter, ratchet mechanism, security fastener removal tip, etc. While the invention may find broad use as a screwdriver, the foregoing description should in no way be read as limiting it to this application.

While in the foregoing there have been set forth preferred embodiments of the invention, it will be appreciated that the details herein given may be varied by those skilled in the art without departing from the true spirit and scope of the appended claims.

I claim:

1. A hand tool for driving a fastener in a clockwise and/or counterclockwise direction, comprising:

means for matingly engaging said fastener for clockwise and/or counterclockwise driven movement in response to rotational movement of said fastener engaging means;

a handle for manually imparting rotational movement to said fastener engaging means to impart driven movement of said fastener in said clockwise and/or counterclockwise direction; and means for releasably retaining said fastener engaging means in operative relationship with said handle, said retaining means comprising a generally cylindrical insert disposed within an opening in said handle and adapted for transmitting manually imparted rotational movement of said handle in a direct and positive manner to said fastener engaging means, said insert also including expandable/contractible spring means for releasably gripping said fastener engaging means;

said insert having an outer surface with a radial undercut spaced from a surface defining said opening in said handle, said radial undercut and said surface defining said opening in said handle together defining a confined and protected spring expansion chamber for housing and accommodating expansion of said expandable/contractible spring means therewithin, said insert also having an axially extending opening at one end and being closed at the other end to releasably receive said fastener engaging means so as to be isolated from engagement with said handle.

2. The fastener driving hand tool of claim 1 wherein said axially extending opening of said insert at said one end is of generally hexagonal shape, said generally hexagonal shape of said opening comprising at least a portion of said movement transmitting means, said fastener engaging means having at least a portion of generally hexagonal shape to be matingly received in said opening of generally hexagonal shape.

3. The fastener driving hand tool of claim 1 wherein said axially extending opening of said insert has a generally cylindrical portion, said opening also having a generally hexagonal portion remote from said one end to define a part of said movement transmitting means, said fastener engaging means having a portion of generally hexagonal shape to be matingly received in said generally hexagonal portion of said opening.

4. The fastener driving hand tool of claim 1 wherein said insert has an outer surface formed with generally axially extending serrations comprising at least a portion of said movement transmitting means, said external spring expansion chamber defined by said radial undercut in said outer surface of said insert being disposed intermediate said ends generally nearer said one end having said axially extending opening.

5. The fastener driving hand tool of claim 1 wherein said external spring expansion chamber defined by said radial undercut in said outer surface of said insert has a smooth outwardly-facing cylindrical surface, said expandable/contractible spring means comprising a detent including a ball disposed in a hole through said cylindrical surface and a band disposed about said cylindrical surface to confine said ball in said hole.

6. The fastener driving hand tool of claim 1 wherein said fastener engaging means comprises a first operative portion in the form of an axially-extending shank to be disposed within said opening in said insert, said fastener engaging means also comprising a second operative portion in the form of a fastener head-conforming tip to be engaged with a head of said fastener for said clockwise and/or counterclockwise driven movement.

7. A hand tool for driving a fastener in a clockwise and/or counterclockwise direction, comprising:

means for matingly engaging said fastener for clockwise and/or counterclockwise driven movement in response to rotational movement of said fastener engaging means;

a handle for manually imparting rotational movement to said fastener engaging means to impart driven movement of said fastener in said clockwise and/or counterclockwise direction; and means for releasably retaining said fastener engaging means in operative relationship with said handle, said retaining means comprising a generally cylindrical handle insert disposed within an opening in said handle and adapted for transmitting manually imparted rotational movement of said handle in a direct and positive manner to said fastener engaging means, said insert also including expandable/contractible spring means for releasably gripping said fastener engaging means;

said insert having an outer surface with a radial undercut spaced from a surface defining said opening in said handle, said radial undercut and said surface defining said opening in said handle together defining a confined and protected spring expansion chamber for housing and accommodating expansion of said expandable/contractible spring means therewithin, said insert also having an axially extending opening at one end and being closed at the other end to releasably receive said fastener engaging means so as to be isolated from engagement with said handle;

said insert having said outer surface formed with a plurality of handle engaging generally axially extending serrations comprising at least a portion of said movement transmitting means, said confined and protected spring expansion chamber being disposed at a point generally intermediate said ends of said insert but nearer said one end having said axially extending opening and having a smooth outwardly-facing cylindrical surface, said expandable/contractible spring means comprising a detent including a ball disposed in a hole through said cylindrical surface and a band disposed about said cylindrical surface to confine said ball in said hole.

8. The fastener driving hand tool of claim 7 wherein said axially extending opening of said insert at said one end is of generally hexagonal shape, said generally hexagonal shape of said opening comprising at least a portion of said movement transmitting means, said fastener engaging means having at least a portion of generally hexagonal shape to be matingly received in said opening of generally hexagonal shape.

9. The fastener driving hand tool of claim 8 wherein said axially extending opening of said insert is of generally hexagonal shape throughout the length thereof, said fastener engaging means comprising a reversible screwdriver tip having first and second tips on opposite ends thereof, said reversible screwdriver tip also having a shank intermediate said first and second tips comprising said portion of generally hexagonal shape.

10. The fastener driving hand tool of claim 7 wherein said axially extending opening of said insert has a generally cylindrical portion, said opening also having a generally hexagonal portion remote from said one end to define a part of said movement transmitting means, said fastener engaging means having a portion of generally hexagonal shape to be matingly received in said generally hexagonal portion of said opening.

11. The fastener driving hand tool of claim 10 wherein said fastener engaging means comprises a generally cylindrical tube having an axially extending opening of generally hexagonal shape in each of opposing ends thereof, said fastener engaging means also including a reversible screwdriver tip in each of said axially extending openings in said tube having first and second tips on opposite ends and an intermediate shank therebetween.

12. The fastener driving hand tool of claim 11 wherein said shank of each of said reversible screwdriver tips is of generally hexagonal shape and a length to project from said tube when fully inserted, said tube being inserted into said axially extending opening of said insert to place the projecting portion of said shank of one of said reversible screwdriver tips in said generally hexagonal portion of said opening in said insert.

* * * * *

UNITED STATES PATENT AND TRADEMARK OFFICE

CERTIFICATE OF CORRECTION

PATENT NO. : 5,533,429

DATED : July 9, 1996

INVENTOR(S) : KOZAK, Burton

It is certified that error appears in the above-identified patent and that said Letters Patent is hereby corrected as shown below:

column 3, line 24, replace "dosed" with --closed--;

column 6, line 3, between "the" and "end" insert --one--.

Signed and Sealed this

Third Day of December, 1996

*Attest:*

*Attesting Officer*

BRUCE LEHMAN

*Commissioner of Patents and Trademarks*